US009637859B2

(12) United States Patent
Altinier et al.

(10) Patent No.: US 9,637,859 B2
(45) Date of Patent: May 2, 2017

(54) ROTATABLE-DRUM LAUNDRY DRIER AND METHOD OF CONTROLLING A ROTATABLE-DRUM LAUNDRY DRIER TO DRY DELICATE LAUNDRY

(75) Inventors: Fabio Altinier, Codognè (IT); Michele Bisaro, Spilimbergo (IT); Roberto Ragogna, Malnisio (IT); Gennaro Napolitano, Pordenone (IT)

(73) Assignee: Electronics Home Products Corporation N.V., Brussels (BE)

( * ) Notice: Subject to any disclaimer, the term of this patent is extended or adjusted under 35 U.S.C. 154(b) by 792 days.

(21) Appl. No.: 13/983,951

(22) PCT Filed: Jan. 25, 2012

(86) PCT No.: PCT/EP2012/051078

§ 371 (c)(1),
(2), (4) Date: Oct. 21, 2013

(87) PCT Pub. No.: WO2012/107280

PCT Pub. Date: Aug. 16, 2012

(65) Prior Publication Data

US 2014/0033562 A1 Feb. 6, 2014

(30) Foreign Application Priority Data

Feb. 11, 2011 (EP) ..... 11154112

(51) Int. Cl.

| | |
|---|---|
| ***F26B 3/00*** | (2006.01) |
| ***D06F 58/08*** | (2006.01) |
| ***D06F 58/28*** | (2006.01) |

(52) U.S. Cl.

CPC ..... *D06F 58/08* (2013.01); *D06F 58/28* (2013.01); *D06F 2058/2803* (2013.01);

(Continued)

(58) Field of Classification Search

CPC .. D06F 58/28; D06F 58/08; D06F 2058/2803; D06F 2058/289;

(Continued)

(56) References Cited

U.S. PATENT DOCUMENTS

| | | | |
|---|---|---|---|
| 2,961,776 | A | 11/1960 | Hughes |
| 5,555,645 | A | 9/1996 | Joslin |

(Continued)

FOREIGN PATENT DOCUMENTS

| | | | |
|---|---|---|---|
| DE | 3820815 | A1 | 12/1989 |
| EP | 1852541 | A1 | 11/2007 |
| EP | 2014822 | A1 | 1/2009 |

OTHER PUBLICATIONS

International Search Report mailed Sep. 20, 2012 in corresponding International Application No. PCT/EP2012/051078.

(Continued)

*Primary Examiner* — Kenneth Rinehart
*Assistant Examiner* — Bao D Nguyen
(74) *Attorney, Agent, or Firm* — Banner & Witcoff, Ltd.

(57) ABSTRACT

A laundry dryer (1) has a laundry drum (3) which is designed to rotate about an longitudinal axis (6). An air recirculating conduit (10) is connected to the laundry drum (3). A heater device (10) is located along air recirculating conduit (10) to heat the airflow. A rotatable fan (11) is located along air recirculating conduit (10) to produce an airflow flowing through drum (3). The fan (11) is designed to be rotated in a main and secondary direction of rotation for providing different air flow rates. An electric motor (14) is mechanically connected with the fan (11) and the drum (3) for rotating the fan (11) and drum (3), simultaneously. The home laundry dryer (1) further has electric control means (18) configured to control the electric motor (14) so as to cause: the drum (3) to rotate at a first rotational speed (v1) in a (Continued)

forward direction of rotation, thereby resulting in the fan (11) being rotated in the main direction of rotation for providing a first air flow rate; or the drum (3) to rotate at a second rotational speed (v2) greater than said first rotational speed (v1) in a reverse direction of rotation, thereby resulting in the fan (11) being rotated in the secondary direction of rotation for providing a second air flow rate lower than the first air flow rate.

20 Claims, 2 Drawing Sheets

(52) U.S. Cl.
CPC ..... *D06F 2058/289* (2013.01); *D06F 2058/2829* (2013.01); *D06F 2058/2838* (2013.01); *D06F 2058/2864* (2013.01); *D06F 2058/2877* (2013.01)

(58) Field of Classification Search
CPC ..... D06F 2058/2838; D06F 2058/2864; D06F 2058/2877; D06F 2058/2829
USPC ..... 34/499
See application file for complete search history.

(56) References Cited

U.S. PATENT DOCUMENTS

| | | | | |
|---|---|---|---|---|
| 5,887,456 | A * | 3/1999 | Tanigawa | D06F 25/00 34/596 |
| 8,104,191 | B2 | 1/2012 | Ricklefs et al. | |
| 2009/0282695 | A1 * | 11/2009 | Kreutzfeldt | D06F 58/203 34/443 |
| 2010/0132219 | A1 * | 6/2010 | Etemad | D06F 58/08 34/499 |

OTHER PUBLICATIONS

European Search Report dated Aug. 8, 2011 in corresponding EP Application No. 11154112.4.

* cited by examiner

ROTATABLE-DRUM LAUNDRY DRIER AND METHOD OF CONTROLLING A ROTATABLE-DRUM LAUNDRY DRIER TO DRY DELICATE LAUNDRY

BACKGROUND

The present invention relates to a rotatable-drum laundry drier, and to a method of controlling a rotatable-drum laundry drier to dry delicate laundry.

In particular, the present invention relates to a kind of rotatable-drum laundry drier comprising: a outer box casing; a cylindrical drum for housing the laundry to be dried, and which is arranged in axially rotating manner inside the casing to rotate about its longitudinal axis, directly facing a laundry loading and unloading opening formed in the front face of the casing; a door hinged to the front face of the casing to rotate to and from a rest position closing the opening in the front face of the casing to seal the casing and the drum; a hot-air generator designed to circulate inside the revolving drum, across a inner recirculating conduit, a stream of hot air with a low moisture content, and which flows through the revolving drum and over the laundry inside the drum to rapidly dry the laundry.

Such a rotatable-drum laundry drier further comprises: a transmission assembly that rotates the drum; a centrifugal fan which is located along the recirculating conduit and is designed to produce, inside the recirculating conduit, an airflow flowing through the drum; and a single electrical motor which drives both the centrifugal fan and the transmission assembly for rotating the revolving drum.

More specifically, the transmission assembly comprises an endless belt which passes around the outer periphery of the drum and around to the shaft of the electric motor, whereas the centrifugal fan is coupled to the electric motor shaft so as to rotate together with the drum.

As is known, drying delicate laundry, such as woolens or similar, in a rotatable-drum laundry drier of the type above disclosed, is a risky operation, on account of the known tendency of delicate laundry to felt and/or undergo other damage. Both substantially depend on a combination of two critical drying factors, such as drying air temperature and surface rubbing of the laundry against the inner wall of the casing or of the drum as it rotates.

To reduce rubbing of the laundry, a rotatable-drum laundry drier has been devised whereby, substantially, the drum is controlled to reach a prefixed high rotation speed during the drying cycle, so that delicate laundry is pressed by centrifugal force against the inner wall of the drum, to which it adheres and is prevented from sliding/tumbling inside the drum. A rotatable-drum laundry of this sort is described, for example, in EP2014822 filed by the Applicant.

Unfortunately, when the electric motor rotates at high rotation speed, the centrifugal fan rotates together with the drum at a high speed and blows a very high air flow rate inside the drum, which tends to separate the laundry from the inner drum surface, causing a gradual movement of the laundry itself towards the laundry opening. Since in the above rotatable-drum laundry drier, the cylindrical drum is shaped so as to present two opposite opened sides then, during the high rotation speed, the laundry is pushed against an inner flange fixed to the casing around the laundry opening, wherein the laundry is subjected to damages and shrinkage.

SUMMARY OF SELECTED INVENTIVE ASPECTS

In-depth research has been carried out by the applicants to achieve the following specific goals:

- preserving the delicate laundry from sliding/tumbling inside drum caused by the air flow rate which centrifugal fan generates when drum is rotated at high speed, and so limiting the damages and shrinkage; and
- using a single electric motor to rotate both the drum and the centrifugal fan simultaneously.

It is therefore an object of the present invention to provide a solution designed to achieve the above goals.

According to the present invention, there is provided a rotatable-drum home laundry drier to dry delicate laundry, as claimed.

A second aspect of the present invention provides a method of controlling a rotatable-drum home laundry drier, as claimed.

According to an aspect of the present invention there is provided a control method for controlling a laundry dryer comprising:

- a laundry drum which is designed to rotate about an longitudinal axis;
- an air recirculating conduit connected to said laundry drum;
- heating means located along said air recirculating conduit to heat the airflow;
- a rotatable fan located along said air recirculating conduit to produce an airflow flowing through said drum; said fan being designed to be rotated in a main and secondary direction of rotation for providing different air flow rates;
- an electric motor which is mechanically connected with the fan and the drum for rotating said fan and drum, simultaneously;

said control method being characterized in controlling said electric motor so as to cause:

- said drum to rotate at a first rotational speed in a forward direction of rotation, thereby resulting in the fan being rotated in the main direction of rotation for providing a first air flow rate; or alternately,
- said drum to rotate at a second rotational speed greater than said first rotational speed in a reverse direction of rotation, thereby resulting in the fan being rotated in the secondary direction of rotation for providing a second air flow rate lower than said first air flow rate.

Preferably, the control method comprises the step of controlling said electric motor so as to cause:

- said drum to rotate at a second rotational speed, thereby resulting in that the centrifugal acceleration of the inner surface of the drum equals gravitational acceleration, so the laundry is pressed by centrifugal force against the inner surface of the drum, as opposed to dropping inside the drum.

Preferably, the control method comprises the step of controlling said electric motor so as to cause said drum to rotate at the second rotational speed in a reverse direction of rotation, when a delicate laundry drying cycle is performed/selected.

Preferably, the control method comprises the step of controlling said electric motor so as to cause said drum to rotate at the first rotational speed in forward direction of rotation, when a not-delicate laundry drying cycle is performed/selected.

Preferably, the laundry dryer comprises temperature measuring means for measuring the air temperature of the air flowing through said drum; and said method performs a first control algorithm when said drum rotates at a forward direction of rotation, so as to perform following steps:

set at least a not-delicate laundry temperature threshold based on said first air flow rate;

measure at least an air temperature by means of said temperature measuring means;

control heating means so as to vary the air temperature according to the difference between measured temperature and not-delicate laundry temperature threshold.

Preferably, the control method performs a second control algorithm when said drum rotates at a reverse direction of rotation, so as to perform following steps:

set at least a delicate laundry temperature threshold based on said second air flow rate; said delicate laundry temperature threshold being different from not-delicate laundry temperature threshold;

measure at least an air temperature by means of said temperature measuring means;

control heating means so as to vary the air temperature according to the difference between measured temperature and delicate laundry temperature threshold.

Preferably, the laundry dryer comprises at least two electrodes contacting the laundry inside the drum; said method performs a first control algorithm when said drum rotates at a forward direction of rotation, so as to perform following steps:

set a first resistance/conductivity threshold based on said first air flow rate;

measure the resistance/conductivity between said two electrodes;

stop the not-delicate laundry drying cycle when the electric/resistance measured between the two electrodes is above or equal to said first resistance/conductivity.

Preferably, the control method performs a second control algorithm when said drum rotates at a reverse direction of rotation, so as to perform following steps:

set a second resistance/conductivity threshold based on said second air flow rate; second resistance/conductivity threshold being different from said first resistance/conductivity threshold;

measure the resistance/conductivity between said two electrodes;

stop the delicate laundry drying cycle when the electric/resistance measured between the two electrodes is above or equal to said second resistance/conductivity.

Preferably, the control method comprises the steps of performing a first control algorithm when said drum rotates at a forward direction of rotation, so as to perform following steps:

set a first drying cycle time based on said first air flow rate;

stop the not-delicate laundry drying cycle at the end of said first drying cycle time.

Preferably, the control method comprises the steps of performing a second control algorithm when said drum rotates at a reverse direction of rotation, so as to perform following steps:

set a second drying cycle time based on said second air flow rate; second drying cycle time being different from said first drying cycle time;

stop the delicate laundry drying cycle at the end of said second drying cycle time.

BRIEF DESCRIPTION OF THE DRAWINGS

A non-limiting embodiment of the present invention will be described by way of example with reference to the accompanying drawings, in which.

DETAILED DESCRIPTION OF EXAMPLE EMBODIMENTS

Figure 1:
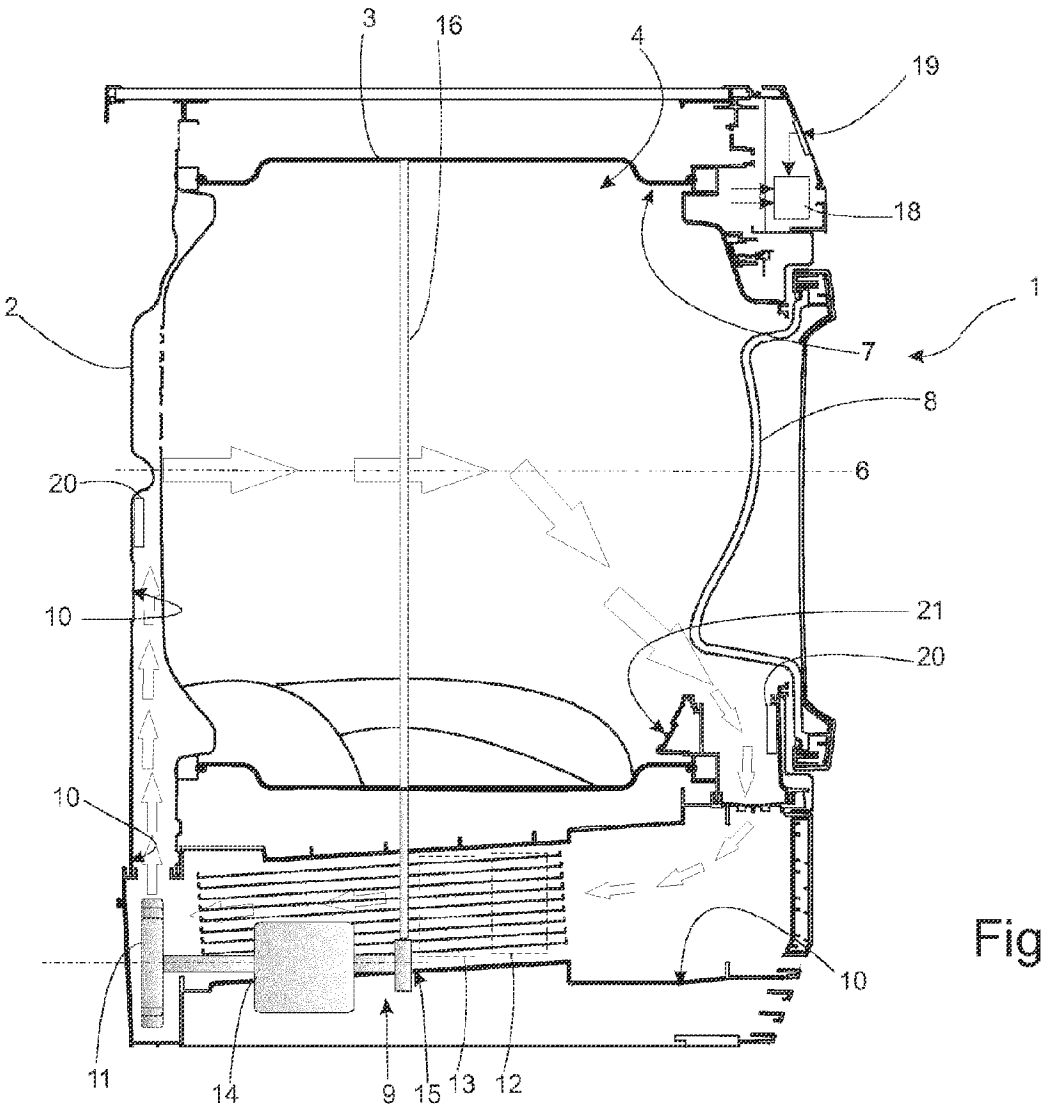
FIG. 1 shows a schematic lateral cross section of a rotatable-drum laundry drier implementing the laundry drying control method according to the present invention.

Number 1 in FIG. 1 indicates as a whole a rotatable-drum laundry drier comprising an outer cabinet/casing 2 that preferably rests on the floor on a number of feet. Casing 2 is preferably designed to support a rotatable laundry drum 3, which defines a drying chamber 4 for laundry and rotates about a preferably, though not necessarily, horizontal rotation axis 6. (In an alternative embodiment not shown, rotation axis 6 may be vertical or inclined).

Drying chamber 4 has a front access opening 7 closable by a door 8 preferably hinged to casing 2.

In the FIG. 1 example, one opened side of the laundry drum 3 is preferably associated, in a rotatable and substantially air-tight way, to a perforated inner wall fixed to a lateral wall of casing 2 and through which hot air flows into drum 3; the other opened side of the drum 3 is preferably associated, in a rotatable and substantially air-tight way, to a flange fixed to casing 2 and interposed between door 8 and front access opening 7 of drum 3.

In this embodiment, laundry drum 3 comprises a substantially cylindrical, hollow revolving drum which preferably, thought not necessarily, extends inside casing 2 coaxial to a substantially horizontally-oriented longitudinal axis 6.

Referring to FIG. 1 laundry drum 3 preferably, thought not necessarily, consists of a substantially cylindrical, rigid tubular body 3 which rests substantially horizontally inside the casing 2 on a number of substantially horizontally-oriented supporting rollers which are located at both axial ends of tubular body 3, and are fixed to the casing 2 in free revolving manner so as to allow the tubular body 3 to freely rotate inside the casing about its horizontally-oriented longitudinal axis 6. Front rim of tubular body 3 is coupled in substantially airtight manner and in axially rotating manner to the front wall of the outer casing 2, so as to surround the laundry front access opening 7 present on that wall; whereas rear rim of tubular body 3 is preferably, thought not necessarily, coupled in substantially airtight manner and in axially rotating manner to an inner bulkhead parallel and spaced to the rear wall of the casing 2.

Referring to FIG. 1, rotatable-drum laundry drier also comprises a hot-air generator 9 housed inside the casing 2, and designed to circulate through drum 3 a stream of hot air having a low moisture level, and which flows over and rapidly dries the laundry inside drying chamber 4.

Hot-air generator 9 provides for gradually drawing air from revolving drum 3; extracting surplus moisture from the air drawn from revolving drum 3; heating the dehumidified air to a predetermined temperature, normally higher than the temperature of the air from revolving drum 3; and feeding the heated, dehumidified air back into revolving drum 3, where it flows over, to rapidly dry, the laundry inside the drum 3.

Referring to FIG. 1, hot-air generator 9 provides for continually dehumidifying and heating the air circulating inside revolving drum 3 to rapidly dry the laundry inside the drum 3/chamber 4, and substantially comprises:

an air recirculating conduit 10 presenting the two opposite ends connected to the revolving laundry drum 3 on opposite opened sides of the latter;

a centrifugal fan 11 located along recirculating conduit 10 to produce inside the latter an airflow which flows into revolving drum 3 and over the laundry inside drum 3;

preferably, a condensing device 12, which is able to cool the airflow coming out from revolving laundry drum 3/chamber 4 for condensing the surplus moisture in the airflow; and heating device 13, which is able to rapidly heat the airflow returning back into revolving laundry drum 3, so that the airflow entering into revolving drum is heated rapidly to a temperature higher than or equal to that of the same air flowing out of the drum 3.

In this embodiment, the centrifugal fan 11 relates to the kind that works more efficiently in a preferential, namely main direction of rotation of the fan rotor than in a secondary direction of rotation of the fan 11 opposite of the main direction of rotation.

Main direction of rotation of the fan 11 is associated with a "forward" direction of rotation of the drum 3 above the rotation axis 6, wherein the fan 11 produces a first air flow rate through the air recirculating conduit 10.

On the other hand, secondary direction of rotation of the fan 11 is associated with a "reverse" direction of rotation of the drum 3, wherein the fan 11 produces a second air flow rate which is lower than first air flow rate associated with the main direction of rotation of the fan 11.

In other words, the fan 11 is designed to maximize the air flow rate when the drum 3 rotate in the "forward" direction of rotation, and to minimize the air flow rate when the drum 3 rotate in the "reverse" direction of rotation.

With regard to heating device 13, it may advantageously comprise a number of electric heating components, such as electric resistors (not shown) located inside the air recirculating conduit 10 to dissipate electric power by Joule effect so as to heat the air supplied to laundry drum 3.

Regarding the condensing device 12, it may comprise a heat-exchanger designed to condense the surplus moisture in the airflow through the air recirculating conduit 10.

It should be pointed out that above described condensing device 12 applies, purely by way of example, to one possible embodiment of the present invention, and may be omitted in the case of an exhaust-type rotatable-drum laundry drier 1 (i.e. in which the hot and moisture-laden drying air from the rotatable laundry drum 3 is expelled directly out of rotatable-drum laundry drier 1).

According to one possible embodiment of the present invention, heating device 13 and condensing device 12 may be replaced with two heat exchangers, i.e. a condenser and an evaporator respectively, comprised within a heat pump assembly (not shown).

Referring to FIG. 1, rotatable-drum laundry drier 1 further comprises an electric motor 14, which drives both the centrifugal fan 11 and a transmission assembly 15 that rotates the revolving laundry drum 3 around the rotation axis 6. Electric motor 14 provides the drum 3 and centrifugal fan 11 rotation simultaneously, to ensure both the laundry movement and, at the same time, the generation of the hot airflow.

Preferably, electric motor 14 has a shaft whose end is pulley-shaped and forms part of the transmission assembly 15 for rotating the revolving laundry drum 3. Accordingly, transmission assembly 15 further comprises an endless belt 16 which passes around the outer periphery of revolving laundry drum 3 and around distal end of the shaft. The distal end of the motor-shaft is designed to drive the belt 16 around the drum 3. The motor-shaft is further connected to the centrifugal fan 11 so as to rotate the latter around a rotational axis, together with the rotation of endless belt 16 of the revolving drum 3.

Preferably, the electric motor 14 is a variable velocity rotation electric motor or similar, i.e. inverter controlled motor, and comprises a three-phase electric motor, i.e. an induction or permanent-magnet electric motor, such as brushless AC motor.

The rotatable-drum laundry drier 1 also comprises an electronic control system 18, which is configured to control the rotatable-drum laundry drier 1 on the basis of a drying cycle selected by a user via a user control interface 19.

Preferably, electronic control system 18 is configured to perform a specific delicate laundry drying cycle associated with delicate laundry.

Moreover, electronic control system 18 is configured to perform one or more "standard"laundry drying cycles, each of which is associated with not-delicate laundry. Delicate laundry drying cycle may comprise a drying cycle specially designed for felt-free and/or shrinkage-free drying wool laundry.

Regarding with "standard" laundry drying cycle, i.e. "not-delicate" laundry drying cycle, it may be programmed to dry laundry which is not particularly subjected to felting and/or shrinkage. Not-delicate laundry may comprise, for example cotton laundry, or synthetic laundry.

When a not-delicate laundry drying cycle is performed/selected, electronic control system 18 controls the electric motor 14 so as to cause the drum 3 to rotate at a first rotational speed vl in the forward direction of rotation, thereby resulting in the fan 11 being rotated in the main direction of rotation for providing the first air flow rate.

When a "delicate" laundry drying cycle, i.e. the wool laundry drying cycle is performed/selected, electronic control system 18 controls the electric motor 14 so as to cause the drum 3 to rotate at a second rotational speed v2 greater than first rotational speed v1 in the reverse direction of rotation, thereby resulting in the fan 11 being rotated in the secondary direction of rotation for providing a second air flow rate lower than first air flow rate.

In a preferred embodiment, when a delicate laundry drying cycle is selected, i.e. the wool laundry drying cycle, electric control system 18 controls the electric motor 18 so as to cause the drum 3 to rotate at the second rotational speed v2 greater or equal than a threshold speed, at which the centrifugal acceleration of the inner surface of the drum 3 equals gravitational acceleration, so the laundry is pressed by centrifugal force against the inner surface of the drum 3, as opposed to dropping inside the drum 3.

It should be pointed out that rotating the drum 3 in the "reverse" direction of rotation at the second rotational speed v2 at which laundry remains kept against inner surface of the drum 3, causes rotation of the fan 11 in the secondary direction of rotation thereby advantageously reducing, on one hand, the air flow rate through the drum 3 and reducing, on the other hand, tendency of laundry to be separated from the inner drum surface. Since the flow rate through the drum 11 is reduced when drum 3 rotates at high speed (second rotational speed v2), and because the laundry is maintained pressed against the inner drum surface, the surface rubbing of the laundry against the inner wall of the casing is heavily reduced.

Figure 2:
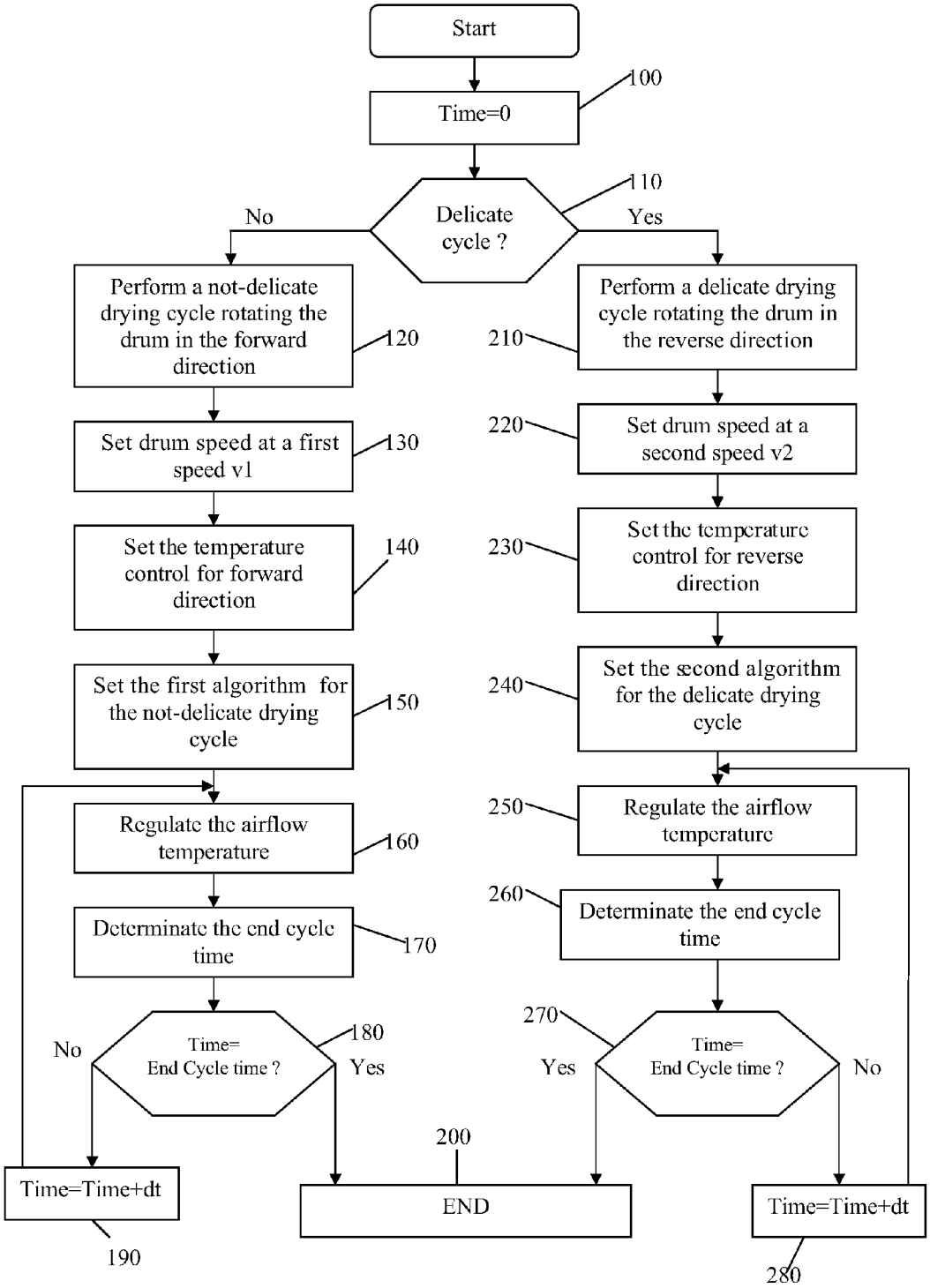
FIG. 2 shows an operation flow chart of the control method implemented by the FIG. 1 rotatable-drum laundry drier.

FIG. 2 shows a flow chart of the operations performed in the control method implemented by electronic control system 18 to control rotatable-drum laundry drier 1.

At the start of the drying cycle, electronic control system 18 assigns a zero value to a time control variable, TIME=0 (block 100), and checks whether the laundry drying cycle, selected by the user, matches the "delicate" laundry drying cycle, i.e. the wool laundry drying cycle (Block 110).

In the negative case (NO output from Block 110), electronic control system 18 determinates the kind of "standard" drying cycle selected by the user and performs the following operations included in the "standard" drying cycle identified.

Electronic control system 18 sets a number of control parameters established in the standard drying cycle. More specifically, a first control parameter is associated with the direction of rotation of the drum 3, a second control parameter is indicative of the rotation speed of the drum, whereas the third control parameter relates to a threshold temperature of the air flowing through the drum 3.

Electronic control system 18 assigns the forward direction of rotation of the drum 3 to the first control parameter (Block 120).

Electronic control system 18 assigns the first rotation speed v1 to the second control parameter (Block 130). The forward direction of rotation of the drum 3 and the first rotation speed v1 causing the fan 11 to rotate in the main direction of rotation thereby resulting in providing the first air flow rate.

In connection with above, it should be pointed out that the first rotation speed vl may be determined according to the kind of the selected standard drying cycle, or rather, it may be changed based on the specific standard drying cycle selected by the user. For example first rotation speed vl related to the "cotton drying cycle" may be different than the first rotation speed vl of the "synthetic drying cycle".

In a preferred embodiment first rotation speed v1 is about 50 rpm (revolutions per minute) and more generally, ranges between 45 and 60 rpm for a drum 3 of above 575 mm in diameter.

Electronic control system 18 further sets at least one not-delicate laundry temperature threshold based on the first air flow rate, which standard drying cycle envisaged (Block 140).

Electronic control system 18 sets a first control algorithm associated with not-delicate laundry cycle according to the first, second and third parameters (Block 150).

Electronic control system 18 starts the not-delicate drying cycle according to first control algorithm and control the electric motor 9 to cause the drum 3 to rotate at a first rotational speed v1 in the forward direction of rotation, thereby resulting in the fan 11 being rotated in the main direction of rotation for providing the first air flow rate.

During the not-delicate drying cycle, electronic control system 18 determines the air temperature by means of temperature measuring device 20 and controls the heating device 13 (or the heat exchanger of the heat pump assembly, i.e. condenser) so as to vary the air temperature according to the difference between measured temperature and not-delicate laundry temperature threshold (Block 160).

In one embodiment of the present invention, temperature measuring device 20 comprises one or more temperature sensors housed inside the air recirculating conduit 10 preferably next to the input/output side of the drum 3.

During the not-delicate drying cycle, electronic control system 18 checks, instant by instant, whether the TIME variable has reached a drying cycle end time (Block 180) and, if not (NO output from Block 180), increments the TIME variable by interval dt (TIME=TIME+dt; Block 190), while if so (YES output from Block 180), it interrupts the drying cycle (Block 200).

It should be pointed out that drying cycle end time may be a value predetermined in the first control algorithm or, according with a preferred embodiment, may be determined/updated on the basis of the humidity of laundry (Block 170). Accordingly, the rotatable-drum dryer 1 may comprise two electrodes 21 contacting the laundry inside the drum 3, whereas the electronic control system 18 may be advantageously configured to measure the resistance/conductivity between the two electrodes and stop the not-delicate laundry drying cycle when the electric/resistance measured between the two electrodes is above or equal to a predetermined first resistance/conductivity.

Referring to FIG. 2, if at the start of the drying cycle, electronic control system 18 determines that delicate laundry drying cycle, i.e. the wool laundry drying cycle is selected (yes output from Block 110), then electronic control system 18 performs the following operations included in the "delicate" drying cycle identified.

Electronic control system 18 sets the first, second and third control parameters established in the delicate drying cycle. In detail, electronic control system 18 assigns the reverse direction of rotation of the drum 3 to the first control parameter (Block 210).

Electronic control system 18 assigns the second rotation speed v2 to the second control parameter (Block 220). In a preferred embodiment second rotation speed v2 is about 70 rpm (revolutions per minute) and more generally, ranges between 65 and 75 rpm for a drum 3 of above 575 mm in diameter.

The reverse direction of rotation of the drum 3 and the second rotation speed v2 causing the fan 11 to rotate in the second direction of rotation thereby resulting in providing the second air flow rate.

It should be pointed out that the second rotation speed v2 may be determined/changed according to the delicate drying cycle.

Electronic control system 18 further sets a delicate laundry temperature threshold to the third control parameter, based on the second air flow rate that delicate drying cycle envisaged (Block 230).

Electronic control system 18 sets a second control algorithm associated with the delicate laundry cycle according to the first, second and third parameters (Block 240).

Electronic control system 18 starts the delicate drying cycle according to second control algorithm and controls the electric motor 9 to cause the drum 3 to rotate at a second rotational speed v2 in the reverse direction of rotation, thereby resulting in the fan 11 being rotated in the secondary direction of rotation for providing the second air flow rate.

During the delicate drying cycle, electronic control system 18 determines the temperature of air flowing through the drum 3, by means of temperature measuring device 20 and controls the heating device 13 so as to vary the air temperature according to the difference between measured temperature and delicate laundry temperature threshold (Block 250).

During the delicate drying cycle, electronic control system 18 checks, instant by instant, whether the TIME variable has reached a drying cycle end time (Block 270) and, if not (NO output from Block 270), increments the TIME variable by interval dt (TIME=TIME+dt; Block 280), while if so (YES output from Block 270), it interrupts the drying cycle (Block 200).

It should be pointed out that drying cycle end time may be a value predetermined in the second control algorithm or, in a preferred embodiment, may be determined/updated on the basis of the measured humidity of laundry (Block 260). Accordingly, electronic control system 18 may be advantageously configured to stop the delicate laundry drying cycle when the electric/resistance measured between the two electrodes is above or equal to a predetermined second resistance/conductivity associated with the second control algorithm.

Rotatable-drum laundry drier 1 has the major advantages of:

preserving the delicate laundry from sliding/tumbling inside drum caused by the air flow rate which centrifugal fan generates when drum contains delicate laundry and rotates at a second rotational speed, and so limiting the damages and shrinkage; and using a single electric motor to rotate both the drum and the centrifugal fan.

Clearly, changes may be made to the rotatable-drum laundry drier as described and illustrated herein without, however, departing from the scope of the present invention.

The invention claimed is:

1. A laundry dryer comprising:

a laundry drum which is designed to rotate about a longitudinal axis;

an air recirculating conduit connected to said laundry drum;

a heating device located along said air recirculating conduit to heat an airflow for flowing through said drum;

a rotatable fan located along said air recirculating conduit to produce the airflow for flowing through said drum; said fan being designed to be rotated in a main and secondary direction of rotation for providing different air flow rates;

an electric motor which is mechanically connected with the fan and the drum for rotating said fan and drum, simultaneously;

said home laundry dryer comprising an electric controller configured to control said electric motor so as to selectively cause:

said drum to rotate at a first rotational speed (v1) in a forward direction of rotation, thereby resulting in the fan being rotated in the main direction of rotation for providing a first air flow rate; and alternatively, said drum to rotate at a second rotational speed (v2) greater than said first rotational speed (v1) in a reverse direction of rotation, thereby resulting in the fan being rotated in the secondary direction of rotation for providing a second air flow rate lower than said first air flow rate, wherein the dryer further comprises a temperature measuring device for measuring air temperature of the air flowing through said drum;

said electric controller being further configured to perform operations of a first control algorithm when said drum rotates at the forward direction of rotation, so as to:

set at least a first laundry temperature threshold based on said first air flow rate;

measure at least an air temperature by means of said temperature measuring device;

control the heating device to vary the air temperature according to the difference between measured temperature and first laundry temperature threshold.

2. The laundry dryer according to claim 1, wherein said electric controller is further configured to perform operations of a second control algorithm, when said drum rotates at the reverse direction of rotation, so as to:

set at least a second laundry temperature threshold based on said second air flow rate; said delicate laundry temperature threshold being different of said second laundry temperature threshold;

measure at least an air temperature by means of said temperature measuring device;

control the heating device so as to vary the air temperature according to the difference between measured temperature and second laundry temperature threshold.

3. The laundry dryer according to claim 1, further comprising a user control interface for selection of at least a first or second laundry drying cycle; wherein when carrying out the first laundry drying cycle, said electric controller is configured to control said electric motor so as to cause said drum to rotate at the first rotational speed (v1) in forward direction of rotation; wherein when carrying out the second laundry cycle, said electric controller is configured to control said electric motor so as to cause said drum to rotate at the second rotational speed (v2) in the reverse direction of rotation.

4. The laundry dryer according to claim 3, wherein said electric controller is further configured to control said electric motor so as to cause:

said drum to rotate at the second rotational speed (v2), thereby resulting in that centrifugal acceleration of an inner surface of the drum equals gravitational acceleration, so laundry is pressed by centrifugal force against the inner surface of the drum, as opposed to dropping inside the drum.

5. The laundry dryer according to claim 3, wherein said second drying cycle is a drying delicate laundry cycle.

6. The laundry dryer according to claim 3, wherein said first drying cycle is a not-delicate laundry drying cycle.

7. A laundry dryer comprising:

a laundry drum which is designed to rotate about a longitudinal axis;

an air recirculating conduit connected to said laundry drum;

a heating device located along said air recirculating conduit to heat an airflow for flowing through said drum;

a rotatable fan located along said air recirculating conduit to produce the airflow for flowing through said drum; said fan being designed to be rotated in a main and secondary direction of rotation for providing different air flow rates;

an electric motor which is mechanically connected with the fan and the drum for rotating said fan and drum, simultaneously;

said home laundry dryer comprising an electric controller configured to control said electric motor so as to selectively cause:

said drum to rotate at a first rotational speed (v1) in a forward direction of rotation, thereby resulting in the fan being rotated in the main direction of rotation for providing a first air flow rate; and alternatively, said drum to rotate at a second rotational speed (v2) greater than said first rotational speed (v1) in a reverse direction of rotation, thereby resulting in the fan being rotated in the secondary direction of rotation for providing a second air flow rate lower than said first air flow rate, wherein the dryer further comprises two electrodes contacting the laundry inside the drum; said electric controller being further configured to perform operation of a first control algorithm, when said drum rotates at the forward direction of rotation, so as to:

set a first resistance/conductivity threshold based on said first air flow rate;

measure resistance/conductivity between said two electrodes;

stop a first laundry drying cycle when the electric/resistance measured between two said electrodes is above or equal to said first resistance/conductivity threshold.

8. The laundry dryer according to claim 7, wherein said electric controller is further configured to run a second control algorithm when said drum rotates at the reverse direction of rotation, so as to:

set a second resistance/conductivity threshold based on said second air flow rate; second resistance/conductivity threshold being different from said first resistance/conductivity threshold;

measure the resistance/conductivity between said two electrodes;

stop a second laundry drying cycle when the electric/resistance measured between the two electrodes is above or equal to said second resistance/conductivity threshold.

9. The laundry dryer according to claim 7, further comprising a user control interface for selection of at least a first or second laundry drying cycle; wherein when carrying out the first laundry drying cycle, said electric controller is configured to control said electric motor so as to cause said drum to rotate at the first rotational speed (v1) in forward direction of rotation; wherein when carrying out the second laundry cycle, said electric controller is configured to control said electric motor so as to cause said drum to rotate at the second rotational speed (v2) in the reverse direction of rotation.

10. The laundry dryer according to claim 9, wherein said electric controller is further configured to control said electric motor so as to cause:

said drum to rotate at the second rotational speed (v2), thereby resulting in that centrifugal acceleration of an inner surface of the drum equals gravitational acceleration, so laundry is pressed by centrifugal force against the inner surface of the drum, as opposed to dropping inside the drum.

11. The laundry dryer according to claim 9, wherein said second drying cycle is a drying delicate laundry cycle.

12. The laundry dryer according to claim 9, wherein said first drying cycle is a not-delicate laundry drying cycle.

13. A laundry dryer comprising:

a laundry drum which is designed to rotate about a longitudinal axis;

an air recirculating conduit connected to said laundry drum;

a heating device located along said air recirculating conduit to heat an airflow for flowing through said drum;

a rotatable fan located along said air recirculating conduit to produce the airflow for flowing through said drum; said fan being designed to be rotated in a main and secondary direction of rotation for providing different air flow rates;

an electric motor which is mechanically connected with the fan and the drum for rotating said fan and drum, simultaneously;

said home laundry dryer comprising an electric controller configured to control said electric motor so as to selectively cause:

said drum to rotate at a first rotational speed (v1) in a forward direction of rotation, thereby resulting in the fan being rotated in the main direction of rotation for providing a first air flow rate; and alternatively, said drum to rotate at a second rotational speed (v2) greater than said first rotational speed (v1) in a reverse direction of rotation, thereby resulting in the fan being rotated in the secondary direction of rotation for providing a second air flow rate lower than said first air flow rate, wherein said electric controller is further configured to perform operations of a first control algorithm, when said drum rotates at the forward direction of rotation, so as to:

set a first drying cycle time based on said first air flow rate; and stop a first laundry drying cycle at end of said first drying cycle time.

14. The laundry dryer according to claim 13, wherein said electric controller is further configured to perform operations of a second control algorithm, when said drum rotates at the reverse direction of rotation, so as to:

set a second drying cycle time based on said second air flow rate; second drying cycle time being different from said first drying cycle time; and stop a second laundry drying cycle at end of said second drying cycle time.

15. A laundry dryer comprising:

a laundry drum which is designed to rotate about a longitudinal axis;

an air recirculating conduit connected to said laundry drum;

a heating device located along said air recirculating conduit to heat an airflow for flowing through said drum;

a rotatable fan located along said air recirculating conduit to produce the airflow for flowing through said drum; said fan being designed to be rotated in a main and secondary direction of rotation for providing different air flow rates;

an electric motor which is mechanically connected with the fan and the drum for rotating said fan and drum, simultaneously;

said home laundry dryer comprising an electric controller configured to control said electric motor so as to selectively cause:

said drum to rotate at a first rotational speed (v1) in a forward direction of rotation, thereby resulting in the fan being rotated in the main direction of rotation for providing a first air flow rate; and alternatively, said drum to rotate at a second rotational speed (v2) greater than said first rotational speed (v1) in a reverse direction of rotation, thereby resulting in the fan being rotated in the secondary direction of rotation for providing a second air flow rate lower than said first air flow rate;

a user control interface for selection of at least a first or second laundry drying cycle;

wherein when carrying out the first laundry drying cycle, said electric controller is configured to control said electric motor so as to cause said drum to rotate at the first rotational speed (v1) in forward direction of rotation;

wherein when carrying out the second laundry cycle, said electric controller is configured to control said electric motor so as to cause said drum to rotate at the second rotational speed (v2) in the reverse direction of rotation;

wherein said electric controller is further configured to perform operations of a first control algorithm, when said drum rotates at the forward direction of rotation, so as to:

set a first drying cycle time based on said first air flow rate; and stop the first laundry drying cycle at an end of said first drying cycle time.

16. The laundry dryer according to claim 15, wherein said electric controller is further configured to perform operations of a second control algorithm, when said drum rotates at the reverse direction of rotation, so as to:

set a second drying cycle time based on said second air flow rate; second drying cycle time being different from said first drying cycle time; and stop the second laundry drying cycle at an end of said second drying cycle time.

17. The laundry dryer according to claim 16, wherein said electric controller is further configured to control said electric motor so as to cause:

said drum to rotate at the second rotational speed (v2), thereby resulting in that centrifugal acceleration of an inner surface of the drum equals gravitational acceleration, so laundry is pressed by centrifugal force against the inner surface of the drum, as opposed to dropping inside the drum.

18. The laundry dryer according to claim 15, wherein said electric controller is further configured to control said electric motor so as to cause:

said drum to rotate at the second rotational speed (v2), thereby resulting in that centrifugal acceleration of an inner surface of the drum equals gravitational acceleration, so laundry is pressed by centrifugal force against the inner surface of the drum, as opposed to dropping inside the drum.

19. The laundry dryer according to claim 15, wherein said second drying cycle is a drying delicate laundry cycle.

20. The laundry dryer according to claim 15, wherein said first drying cycle is a not-delicate laundry drying cycle.

* * * * *